US005879245A

United States Patent [19]

Hwang

[11] Patent Number: 5,879,245

[45] Date of Patent: Mar. 9, 1999

[54] GOLF BALL

[75] Inventor: In Hong Hwang, Seoul, Rep. of Korea

[73] Assignee: Ilya Co., Ltd., Seoul, Rep. of Korea

[21] Appl. No.: 833,655

[22] Filed: Apr. 8, 1997

[30] Foreign Application Priority Data

Oct. 1, 1996 [KR] Rep. of Korea ..... 1996 43352

[51] Int. Cl.[6] ..... A63B 37/14

[52] U.S. Cl. ..... 473/384

[58] Field of Search ..... 473/383, 384; 273/232

[56] References Cited

U.S. PATENT DOCUMENTS 878,254 2/1908 Taylor ..... 473/384

FOREIGN PATENT DOCUMENTS 1459646 12/1976 United Kingdom ..... 273/232

*Primary Examiner*—George J. Marlo

*Attorney, Agent, or Firm*—Amster, Rothstein & Ebenstein

[57] ABSTRACT

A golf ball defining a spherical surface divided into spherical polyhedrons to form dimples thereon, characterized in that at least some of the dimples are connected to one another via air connection channels no more than 4 mm wide no more than 5 mm long, and no more than 1.2 mm deep the channel depth being less that 70% of the depth of the dimples.

11 Claims, 6 Drawing Sheets

GOLF BALL

TECHNICAL FIELD

The present invention relates to a golf ball, and more specifically, to an improved golf ball which has channel to contribute to the continuous flow of air through dimples of the ball during its flying.

BACKGROUND OF THE INVENTION

Every golf ball has many dimples on its surface, whose arrangement, size, shape, and depth determine various flying characteristics. Generally, to arrange dimples on a ball its surface is to be divided into spherical polyhedrons whose purpose is to keep the symmetry of ball, get uniform repelling power of pneumatic dynamics on dimples, and thus obtain certain flying stability. Dimples also have a variety of patterns like circle, oval, spheroid, and polygon, among which circular or circular plus partially oval dimples are most frequently used, And their sizes are either uniform or different, and it is the same with their depths.

As for the ball with dimples which are of circle or of circle plus partial oval, by the way, it is impossible to see maximum fly or flying stability as expected in terms of its characteristics of the optimum construction and arrangement of demples and properties of matter. It is because it flies in back spin to make circular dimples located at the back and both sides of ball subject to partial vacuum leading to excessive drag (to pull ball against its ongoing direction), in other words it loses much of energy to be transmitted to it when hit. Back spin, however, is likely to give lift to golf ball helping it fly higher and longer, which is an antinomic situation of the loss of energy due to excessive drag described above.

Accordingly, it is an object of the present invention to minimize drag, obtain proper lift, and maintain original properties of golf ball to maximize its fly.

SUMMARY OF THE INVENTION

The basic concept of the present invention is to provide golf ball having channel which allows the flow of air through adjacent dimples, circular or oval or both, having distinct borders and being independent (hereinafter referred to as "air connection channel") to contribute to the continuous flow of air through dimples of the golf ball during its flying. Then the channel would swiftly disperse to next dimples the vacuum generated during its flying in back spin, which minimizes drag contributing to the improvement of fly and flying stability.

Further objects and advantages of the present invention will become apparent from the following detailed description and accompanying drawings.

DETAILED DESCRIPTION OF THE INVENTION

Figure 1:
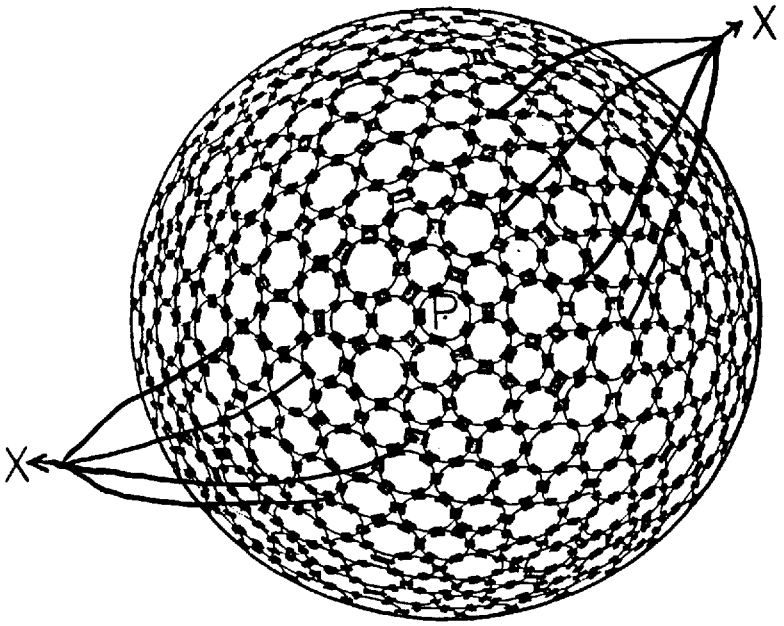
FIG. 1 shows the surface of an invented golf ball looked from a pole.

FIG. 1 shows the surface of an invented golf ball looked from a pole, which is divided into composition of spherical polyhedrons to arrange dimples on it, resulting in air connection channels connecting dimples one another (darlk squares marked X) and successive, rather than independent, gathering of dimples. Though only some dark squares are marked X in this figure, all of them are air connection channels. In fact, these dark parts have two sides belonging to a circular arc and other two sides rather resembling straight lines, and this shape of the square applies to all other ones described below.

Figure 2:
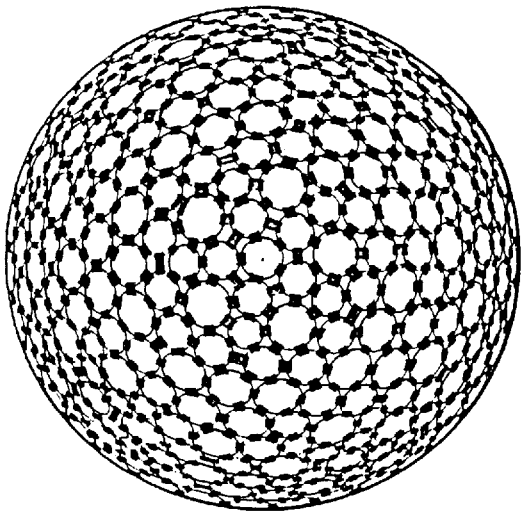
FIG. 2 shows the surface of an invented golf ball looked from a pole, an example of polyhedron composition as in FIG. 1.

FIG. 2 shows the surface of an invented golf ball looked from a pole, an example of polyhedron composition as in FIG. 1, which arranges dimples and forms air connection channels for connecting them by dividing the surface of ball by 20 or 20–12 sides. It is a figure showing an example of well completed ball according to the invention.

Figure 3:
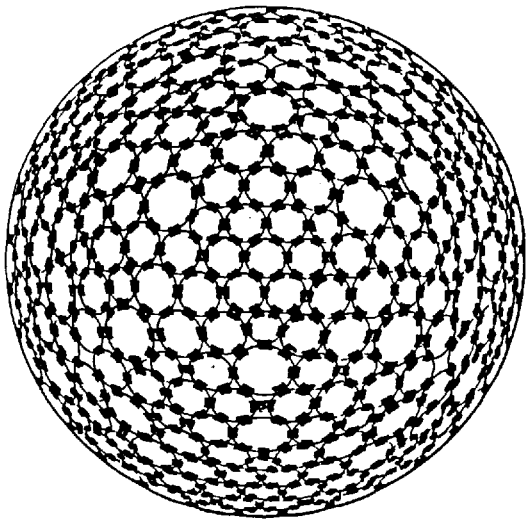
FIG. 3 shows the surface of an invented golf ball looked from a pole, an example of polyhedron composition as in FIG. 1.

FIG. 3 shows the surface of an invented golf ball looked from a ploe, an example of polyhedron composition as in FIG. 1, which arranges dimples and forms air connection channels for connecting them by dividing the surface of ball by 8 or 6–8 sides. It is a figure showing an example of well completed ball according to the invention.

Figure 4:
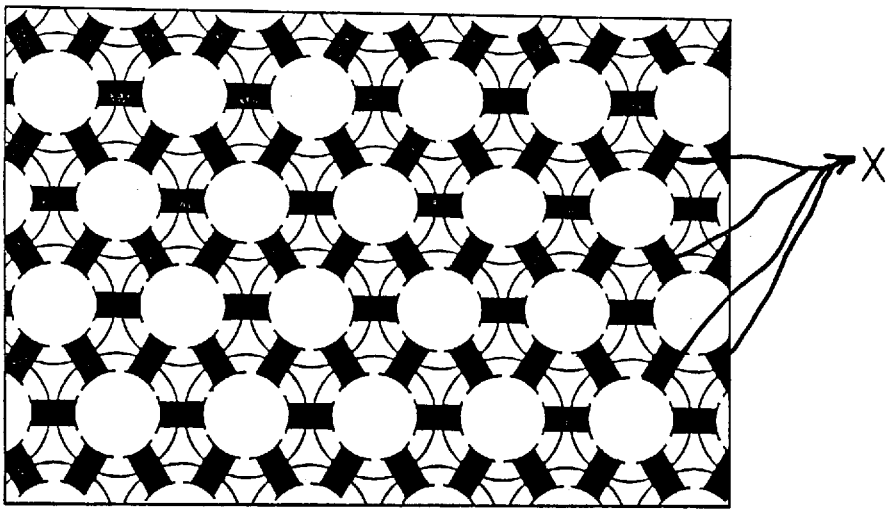
FIG. 4 is a development figure describing a typical pattern of air connection channel (dark squares marlsed X) connecting dimples in accordance with the invention.

FIG. 4 is a development figure describing a typical pattern of air connection channel (dark squares marked X) connecting dimples; again, only some dark squares are marked X in this figure, but all of them are air connection channels. In fact, these dark parts have two sides belonging to a circular arc and other two sides rather resembling straight lines, and this shape of the square applies to all other ones described below.

Figure 5:
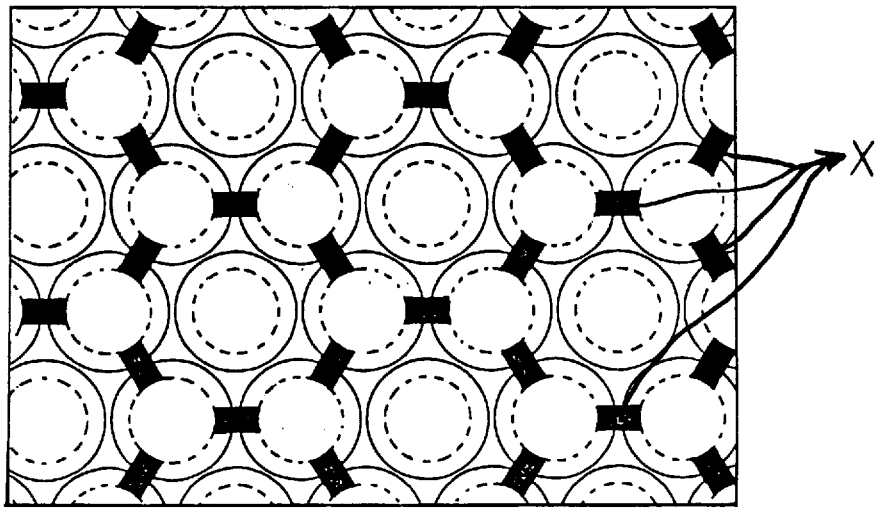
FIG. 5 is same as FIG. 4, a development figure describing another pattern of air connection channel (dark squares marked X) connecting dimples, however except that some dimples have air connection channels but other do not, indicating various ways of connecting dimples using air connection channels in this invention.

FIG. 5 is same as FIG. 4, a development figure describing a typical pattern of air connection channel (dark squares marked X) connecting dimples, however except that some dimples have air connection channels but other do not, indicating various ways of connecting dimples using air connection channels in this invention; again, only some dark squares are marked X in this figure, but all of them are air connection channels. In fact, these dark parts have two sides belonging to a circular arc and other two sides rather resembling straight lines, and this shape of the square applies to all other ones described below.

Figure 6:
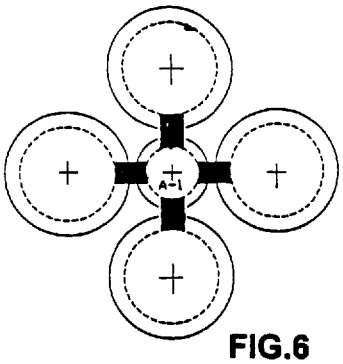
FIGS. 6–13 demonstrate how many air connection channels a dimple has, if dimples on a ball are connected with air connection channels and the dimple is contiguous to a plurality of dimples.

FIG. 6 demonstrates that a dimple marked A-1 has four air connection channels, if dimples on a ball are connected with air connection channels and it is contiguous to four dimples.

Figure 7:
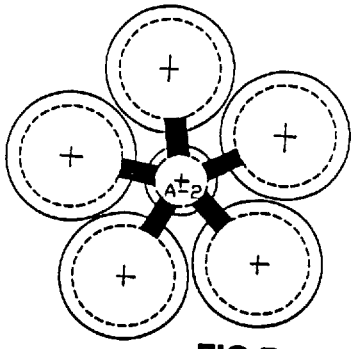

FIG. 7 demonstrates that a dimple marked A-2 has five air connection channels, if dimples on a ball are connected with air connection channels and it is contiguous to five dimples.

Figure 8:
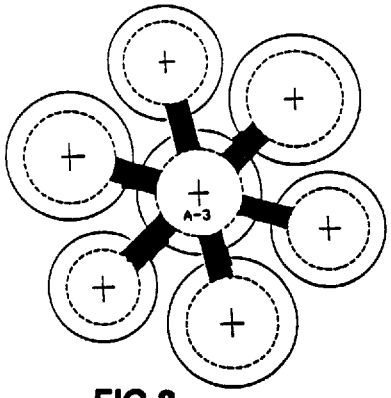

FIG. 8 demonstrates that a dimple marked A-3 has six air connection channels, if dimples on a ball are connected with air connection channels and it is contiguous to six dimples.

Figure 9:
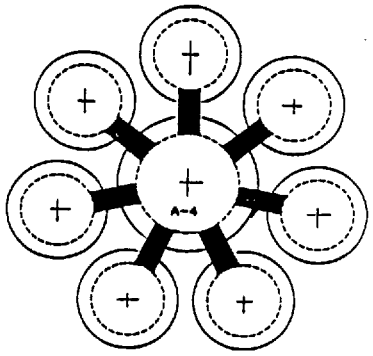

FIG. 9 demonstrates that a dimple marked A-4 has seven air connection channels, if dimples on a ball are connected with air connection channels and it is contiguous to seven dimples.

Figure 10:
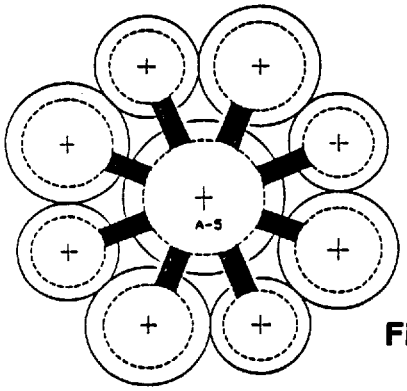

FIG. 10 demonstrates that a dimple marked A-5 has eight air a connection channels, if dimples on a ball are connected with air connection channels and it is contiguous to eight dimples.

Figure 11:
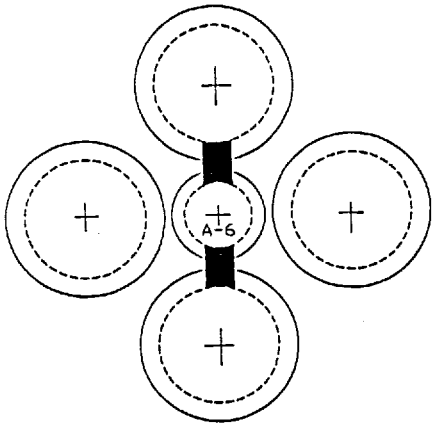

FIG. 11 demonstrates that a dimple marked A-6 has two air connection channels, if dimples on a ball are connected with air connection channels and it is contiguous to four dimples.

Figure 12:
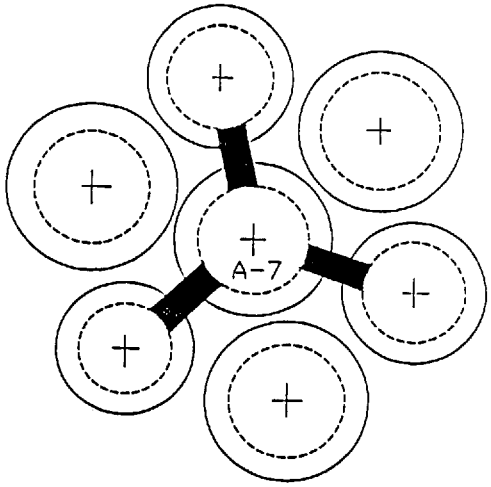

FIG. 12 demonstrates that a dimple marked A-7 has three air connection channels, if dimples on a ball are connected with air connection channels and it is contiguous to six dimples.

Figure 13:
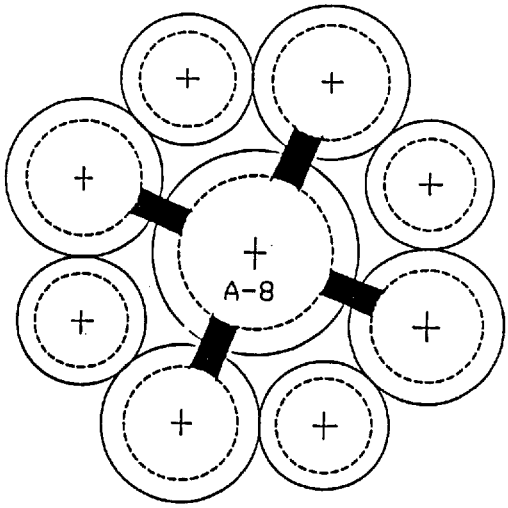

FIG. 13 demonstrates that a dimple marked A-8 has four air connection channels, if dimples on a ball are connected with air connection channels and it is contiguous to eight dimples.

Figure 14:
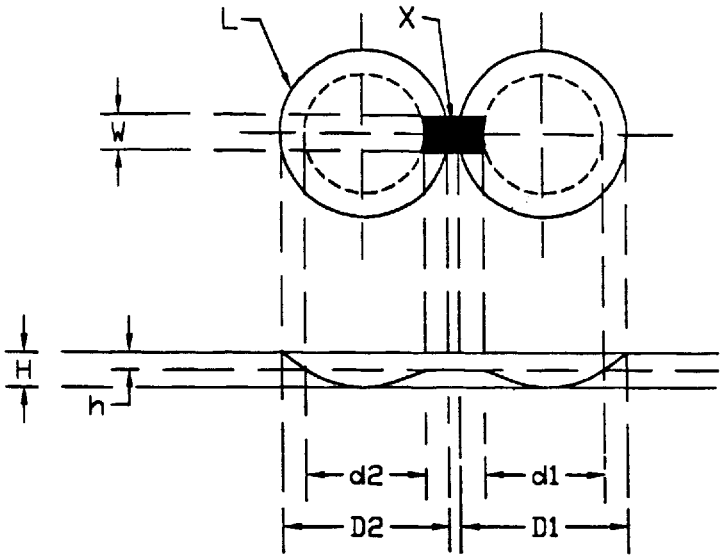
FIG. 14 depicts sections of two dimples, as air connection channels are formed, as well as the way of determining the depth and diameter of two dimples whose diameters are different each other and the depth and length of their air connection channels, as both dimples are connected via air connection channel.
Figure 15:
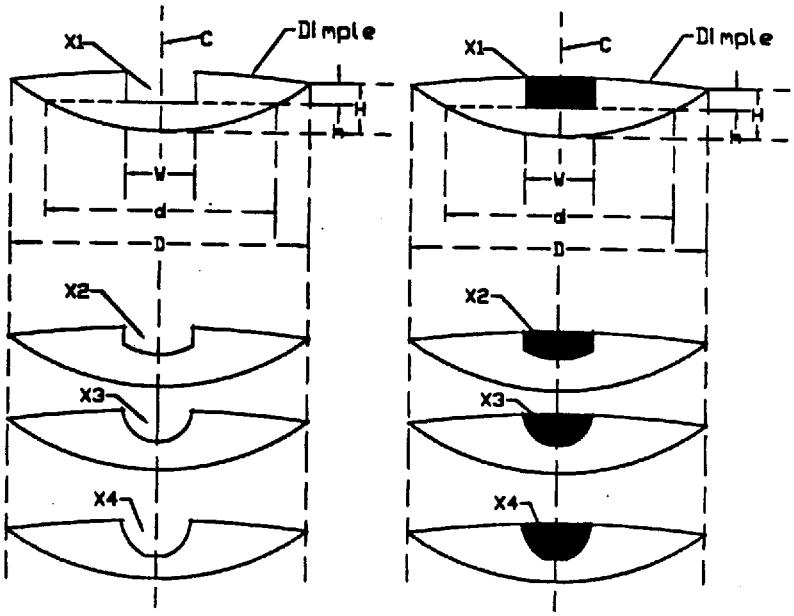
FIG. 15 shows the way of determining the proper depth, length, and width of air connection channels for dimples, various shapes of sections of air connection channels (marked X1, X2, X3, and X4), and real patterns of sections after air connection channels are made to the left picture.

As the way of making air connection channels and their patterns and sizes are described in FIGS. 14 and 15, the channel is made by drawing a line connecting the center of each dimple between adjourning ones and establishing certain width W from the line. The limitations of W are as follows: If a dimple whose diameter is D is close by several dimples, either all of them may have each one's air connection channel as in FIGS. 6, 7, 8, 9, and 10 or only some of them may have them as in FIGS. 11, 12, and 13; if there are N air connection channels, the sum of each W around the dimple whose diameter is D is recommended to be not more than 70% of the circumference L of the dimple. Here, the type of diameter of the dimple may be one and the same or 2 to 10 kinds. And W of one air connection channel X is recommended to be between 0.1 mm and 4 mm.

For the length of air connection channel, W is obtained by establishing a random, short diameter d1, to a dimple whose diameter is D1 and establishing another random, short diameter, d2, to a dimple whose diameter is D2, while the length is by connecting random each two points located on d1 and d2 in parallel, as in FIG. 14. And it is recommended to be not longer than 5 mm. The random, short diameter of d in a dimple whose diameter is D shall be determined, as shown in FIG. 15 to be more than 50% of D, because it would face more air resistance during its flying and its flying stability would be reduced, if it is less than 50%. For the depth of air connection channels, the depth of a random, short diameter d would be h, as that of a dimple whose diameter is D is H, as in FIGS. 14 and 15; h is recommended to be less than 70% of H or 1.2 mm. If h is deeper than it, it would disturb the air flow in dimples to worsen its flying stability.

A channel having a curved bottom has a different depth at different locations along its bottom surface. Also, a channel having inward curved sides has one width at the upper end and a lower width at the bottom end. Also, the length of a channel will vary depending upon whether it is measured along the exterior of the golf ball or along the bottom of the channel to the point where it enters a curved bottom dimple surface.

The sections of air connection channels may have various patterns such as X1, X2, X3, and X4 as shown in FIG. 15, which have basic relations with the depth of dimples. Generally speaking, square pattern is recommended for the dimple with shallow depth, while half-circle for the one with deep depth. In short, one should consider the depth of dimples in choosing its pattern. A dimple may share air connection channels either with all of its adjoining dimples as in FIGS. 6, 7, 8, 9, and 10 or with only some of its adjoining dimples-with no channels for remaining dimples as in FIGS. 11, 12, and 13. It is closely related with the arrangement of dimples—that all have air connection channels or that only some have channels depends on what kind of solid, uniform size or different size/shape, forms the spherical polyhedrons divided from sphere. In other words, the arrangement of dimples on a golf ball shall be determined considering air flow and if all of the dimples are uniform or not.

As such, a golf ball was invented to increase its fly sharply and reduce drag outstandingly, as in FIGS. 2 and 3, by executing air connection channels in it.

What is claimed is:

1. A golf ball defining a spherical surface divided into spherical polyhedrons to arrange form dimples thereon, said golf ball being characterized in that at least some of said dimples are connected to one another via air connection no more than 4 mm wide, no more than 5 mm long, and no more than 1.2 mm deep, said channel depth being less than 70% of the depth of said some dimples.

2. A golf ball according to claim 1 characterized in that all of said dimples are connected via air connection channels.

3. A golf ball according to claim 1 characterized in that some of said dimples are connected via air connection channels, but others are not.

4. A golf ball according to claim 3 characterized in that some of said dimples are connected to only some adjoining dimples via air connection channels, but not to adjoining dimples.

5. A golf ball according to claim 3 characterized in that some parts of the surface of the golf ball are connected to adjoining dimples via air connection channels, but other parts are not so connected.

6. A golf ball according to claim 1 characterized in that each said dimple has the same diameter.

7. A golf ball according to any one of the preceding claims characterized in that the diameter of said dimples varies.

8. A golf ball according to claim 7 characterized in that the diameter of said dimples vary between 0.8 mm and 6 mm.

9. A golf ball according to claim 1 characterized in that each said dimples has the same depth.

10. A golf ball according to any one of the preceding claims characterized in that the depth of said dimples varies.

11. A golf ball according to claim 1 characterized in that the depths of said dimples differ.

* * * * *